US010738559B2

(12) United States Patent
Streich et al.

(10) Patent No.: US 10,738,559 B2
(45) Date of Patent: Aug. 11, 2020

(54) DOWNHOLE TOOLS COMPRISING COMPOSITE SEALING ELEMENTS

(71) Applicant: Halliburton Energy Services, Inc., Houston, TX (US)

(72) Inventors: Steven G. Streich, Duncan, OK (US); Charles T. Smith, McKinney, TX (US); Paul M. Rau, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 629 days.

(21) Appl. No.: 14/433,715

(22) PCT Filed: Jun. 13, 2014

(86) PCT No.: PCT/US2014/042369

§ 371 (c)(1),
(2) Date: Apr. 6, 2015

(87) PCT Pub. No.: WO2015/191085

PCT Pub. Date: Dec. 17, 2015

(65) Prior Publication Data

US 2016/0258241 A1 Sep. 8, 2016

(51) Int. Cl.
*E21B 33/12* (2006.01)

(52) U.S. Cl.
CPC ..... *E21B 33/12* (2013.01); *E21B 33/1208* (2013.01)

(58) Field of Classification Search
CPC .... E21B 33/12; E21B 33/1208; E21B 33/134; E21B 2034/002; E21B 43/26
See application file for complete search history.

(56) References Cited

U.S. PATENT DOCUMENTS

| | | | |
|---|---|---|---|
| 3,780,805 | A | 12/1973 | Green |
| 3,934,420 | A | 1/1976 | Janelid et al. |
| 4,018,282 | A | 4/1977 | Graham et al. |
| 4,018,283 | A | 4/1977 | Watkins |
| 5,709,269 | A | 1/1998 | Head |
| 6,380,138 | B1 | 4/2002 | Ischy et al. |
| 6,390,195 | B1 | 5/2002 | Nguyen et al. |
| 6,457,525 | B1 | 10/2002 | Scott |
| 6,766,858 | B2 | 7/2004 | Nguyen et al. |
| 7,059,410 | B2 | 6/2006 | Bousche et al. |
| 7,281,583 | B2 | 10/2007 | Whitfill et al. |
| 7,350,576 | B2 | 4/2008 | Robertson et al. |
| 7,353,879 | B2 | 4/2008 | Todd et al. |
| 7,451,815 | B2 | 11/2008 | Hailey, Jr. |
| 7,478,678 | B2 | 1/2009 | Farrar et al. |
| 7,575,055 | B2 | 8/2009 | Reddy et al. |
| 7,647,964 | B2 | 1/2010 | Akbar et al. |

(Continued)

FOREIGN PATENT DOCUMENTS

| | | | |
|---|---|---|---|
| WO | 1985001309 | A1 | 3/1985 |
| WO | 2008057726 | A2 | 5/2008 |
| WO | 2015191085 | A1 | 12/2015 |

*Primary Examiner* — David Carroll

(74) *Attorney, Agent, or Firm* — McGuireWoods LLP

(57) ABSTRACT

A downhole tool comprising a body and a sealing element, wherein the sealing element is composed of a composite material comprising a rubber and a degradable acrylate-based polymer, and wherein at least a portion of the degradable acrylate-based polymer degrades when exposed to an aqueous fluid in a wellbore environment.

18 Claims, 3 Drawing Sheets

(56) References Cited

U.S. PATENT DOCUMENTS

| | | | | |
|---|---|---|---|---|
| 7,712,541 | B2 | 5/2010 | Loretz et al. | |
| 7,798,236 | B2 | 9/2010 | McKeachnie et al. | |
| 7,806,189 | B2 | 10/2010 | Frazier | |
| 7,935,662 | B2 | 5/2011 | Parlar et al. | |
| 7,938,186 | B1 | 5/2011 | Badalamenti et al. | |
| 2008/0169105 | A1* | 7/2008 | Williamson | E21B 33/1208 166/374 |
| 2008/0308282 | A1* | 12/2008 | Standridge | E21B 33/1285 166/387 |
| 2009/0038796 | A1* | 2/2009 | King | E21B 23/06 166/277 |
| 2009/0038800 | A1* | 2/2009 | Ravi | C04B 28/02 166/292 |
| 2009/0242214 | A1* | 10/2009 | Foster | E21B 23/01 166/387 |
| 2009/0255674 | A1* | 10/2009 | Boney | E21B 33/138 166/284 |
| 2011/0005778 | A1* | 1/2011 | Foster | E21B 23/01 166/382 |
| 2011/0067889 | A1* | 3/2011 | Marya | E21B 33/134 166/386 |
| 2014/0102728 | A1* | 4/2014 | Gamstedt | E21B 33/1208 166/387 |
| 2015/0060069 | A1* | 3/2015 | Potapenko | E21B 33/138 166/284 |

* cited by examiner

DOWNHOLE TOOLS COMPRISING COMPOSITE SEALING ELEMENTS

BACKGROUND

The present disclosure generally relates to downhole tools comprising a body and a sealing element composed of a composite material comprising a rubber and a degradable acrylate-based polymer, wherein at least a portion of the degradable acrylate-based polymer degrades upon exposure to an aqueous fluid in a wellbore environment.

A variety of downhole tools are within a wellbore in connection with producing or reworking a hydrocarbon bearing subterranean formation. The downhole tool may comprise a wellbore zonal isolation device capable of fluidly sealing two sections of the wellbore from one another and maintaining differential pressure (i.e., to isolate one pressure zone from another). The wellbore zonal isolation device may be used in direct contact with the formation face of the wellbore, with casing string, with a screen or wire mesh, and the like.

After the production or reworking operation is complete, the seal formed by the downhole tool must be broken and the tool itself removed from the wellbore. The downhole tool must be removed to allow for production or further operations to proceed without being hindered by the presence of the downhole tool. Removal of the downhole tool(s) is traditionally accomplished by complex retrieval operations involving milling or drilling the downhole tool for mechanical retrieval. In order to facilitate such operations, downhole tools have traditionally been composed of drillable metal materials, such as cast iron, brass, or aluminum. These operations can be costly and time consuming, as they involve introducing a tool string (e.g., a mechanical connection to the surface) into the wellbore, milling or drilling out the downhole tool (e.g., at least breaking the seal), and mechanically retrieving the downhole tool or pieces thereof from the wellbore to bring to the surface.

To reduce the cost and time required to mill or drill a downhole tool from a wellbore for its removal, dissolvable or degradable downhole tools have been developed. Traditionally, however, such dissolvable downhole tools have been designed only such that the dissolvable portion includes the tool body itself and not any sealing element of the downhole tool. This is particularly evident because the dissolvable materials that have been proposed for use in forming a downhole tool body are often highly brittle and are physically or chemically incapable of exhibiting expansive or elastic properties necessary for a sealing element. Instead, the known dissolvable downhole tools may dissolve such that it no longer provides the structural integrity necessary for achieving an effective seal with the non-dissolvable sealing element.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
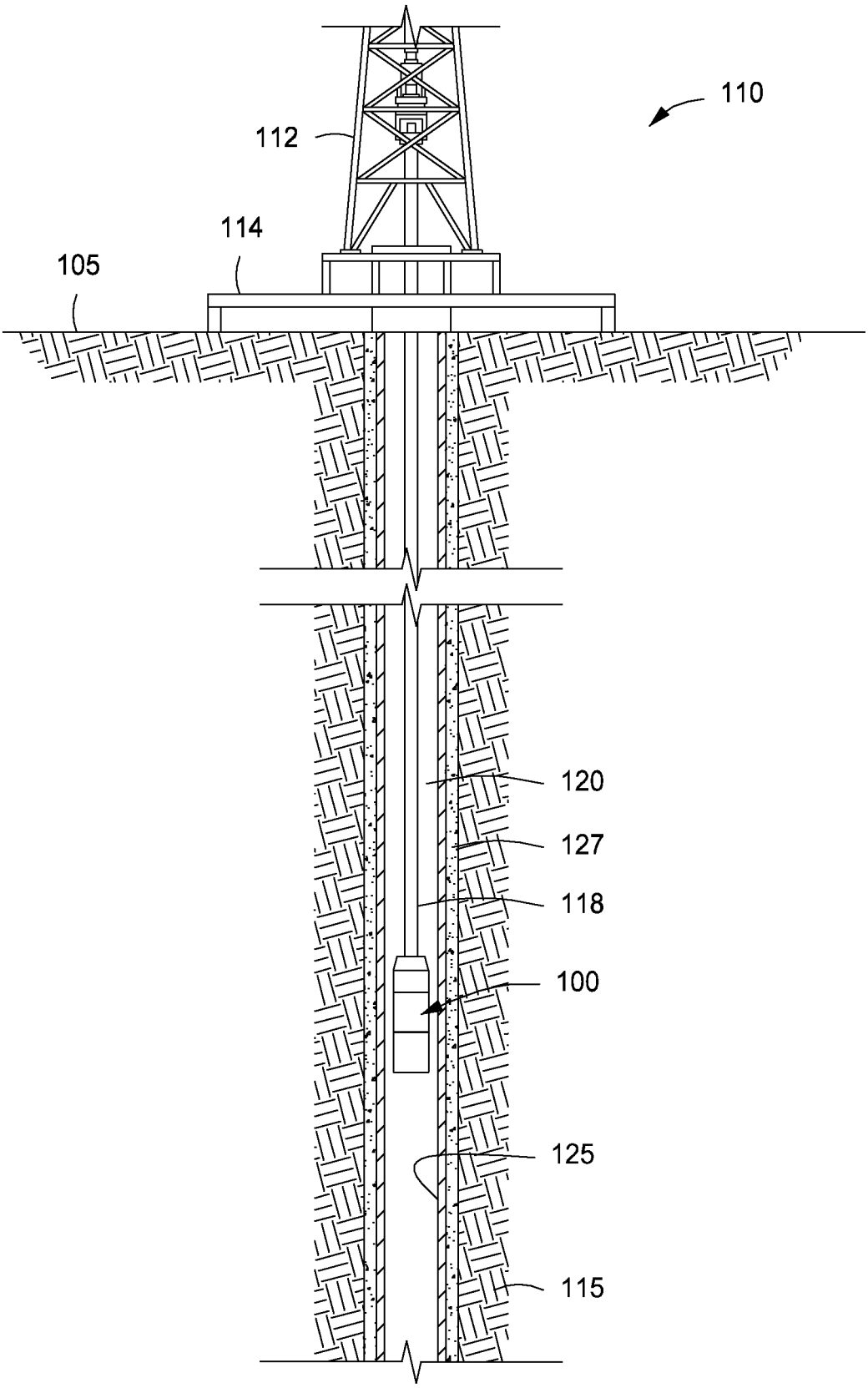
FIG. 1 illustrates a cross-sectional view of a well system comprising a downhole tool, according to one or more embodiments described herein.

The present disclosure generally relates to downhole tools comprising a body and a sealing element composed of a composite material comprising a rubber and a degradable acrylate-based polymer, wherein at least a portion of the degradable acrylate-based polymer degrades upon exposure to a wellbore environment. As used herein, the term "degradable" and all of its grammatical variants (e.g., "degrade," "degradation," "degrading," and the like) refers to the process of or the ability to break down wholly or partially by any mechanism.

Disclosed are various embodiments of a downhole tool comprising a body and a sealing element composed of a composite material, the sealing element capable of fluidly sealing two sections of a wellbore (which may be also referred to as "setting" the downhole tool). The downhole tool may have various setting mechanisms for fluidly sealing the sections of the wellbore with the sealing element including, but not limited to, hydraulic setting, mechanical setting, setting by swelling, setting by inflation, and the like. The downhole tool may be a well isolation device, such as a frac plug, a bridge plug, or a packer, a wiper plug, a cement plug, or any other tool requiring a sealing element for use in a downhole operation. Such downhole operations may include, but are not limited to, any type of fluid injection operation (e.g., a stimulation/fracturing operation, a pinpoint acid stimulation, casing repair, and the like). In some embodiments, the downhole tool may comprise a body and at least one sealing element composed of a composite material comprising a rubber and a degradable acrylate-based polymer. The degradable acrylate-based polymer comprising part of the composite material of the sealing element may degrade upon contact with an aqueous fluid in a wellbore environment. As used herein, the term "polymer" includes copolymers and terpolymers.

The embodiments herein permit fluid sealing of two wellbore sections with the downhole tool using the sealing elements described herein. The sealing element comprises a composite material of rubber and a degradable acrylate-based polymer, and the degradable acrylate-based polymer that later degrades in situ, preferably without the need to mill or drill, and retrieve the downhole tool from the wellbore. In particular, the degradation of the degradable acrylate-based polymer results in failure of the sealing element to maintain differential pressure and form an effective seal. In some embodiments, the downhole tool may drop into a rathole in the wellbore without the need for retrieval. It will be appreciated by one of skill in the art that while the embodiments herein are described with reference to a downhole tool, the sealing elements composed of the composite materials disclosed herein may be used with any wellbore operation equipment that may preferentially degrade upon exposure to aqueous fluids.

One or more illustrative embodiments disclosed herein are presented below. Not all features of an actual implementation are described or shown in this application for the sake of clarity. It is understood that in the development of an embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressed in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Referring now to FIG. 1, illustrated is an exemplary well system 110 for a downhole tool 100. As depicted, a derrick 112 with a rig floor 114 is positioned on the earth's surface 105. A wellbore 120 is positioned below the derrick 112 and the rig floor 114 and extends into subterranean formation 115. As shown, the wellbore may be lined with casing 125 that is cemented into place with cement 127. It will be appreciated that although FIG. 1 depicts the wellbore 120 having a casing 125 being cemented into place with cement 127, the wellbore 120 may be wholly or partially cased and wholly or partially cemented (i.e., the casing wholly or partially spans the wellbore and may or may not be wholly or partially cemented in place), without departing from the scope of the present disclosure. Moreover, the wellbore 120 may be an open-hole wellbore. A tool string 118 extends from the derrick 112 and the rig floor 114 downwardly into the wellbore 120. The tool string 118 may be any mechanical connection to the surface, such as, for example, wireline, slickline, jointed pipe, or coiled tubing. As depicted, the tool string 118 suspends the downhole tool 100 for placement into the wellbore 120 at a desired location to perform a specific downhole operation. As previously mentioned, the downhole tool 100 may be any type of wellbore zonal isolation device including, but not limited to, a frac plug, a bridge plug, a packer, a wiper plug, or a cement plug.

It will be appreciated by one of skill in the art that the well system 110 of FIG. 1 is merely one example of a wide variety of well systems in which the principles of the present disclosure may be utilized. Accordingly, it will be appreciated that the principles of this disclosure are not necessarily limited to any of the details of the depicted well system 110, or the various components thereof, depicted in the drawings or otherwise described herein. For example, it is not necessary in keeping with the principles of this disclosure for the wellbore 120 to include a generally vertical cased section, or is it necessary that the well system 110 be a land-based system as subsea systems are equally applicable to the embodiments herein. The well system 110 may equally be employed in vertical and/or deviated wellbores, without departing from the scope of the present disclosure. Furthermore, it is not necessary for a single downhole tool 100 to be suspended from the tool string 118.

In addition, it is not necessary for the downhole tool 100 to be lowered into the wellbore 120 using the derrick 112. Rather, any other type of device suitable for lowering the downhole tool 100 into the wellbore 120 for placement at a desired location may be utilized without departing from the scope of the present disclosure, such as, for example, mobile workover rigs, well servicing units, and the like. Although not depicted, the downhole tool 100 may alternatively be hydraulically pumped into the wellbore and, thus, not need the tool string 118 for delivery into the wellbore 120.

Although not depicted, the structure of the downhole tool 100 may take on a variety of forms to provide fluid sealing between two wellbore sections. The downhole tool 100, regardless of its specific structure as a specific type of wellbore zonal isolation device, comprises a body and a sealing element. Both the body and the sealing element may each be composed of the same material. Generally, however, the body provides structural rigidity and other mechanical features to the downhole tool 100 and the sealing element is a resilient or elastic material capable of providing a fluid seal between two sections of the wellbore 120.

Figure 2:
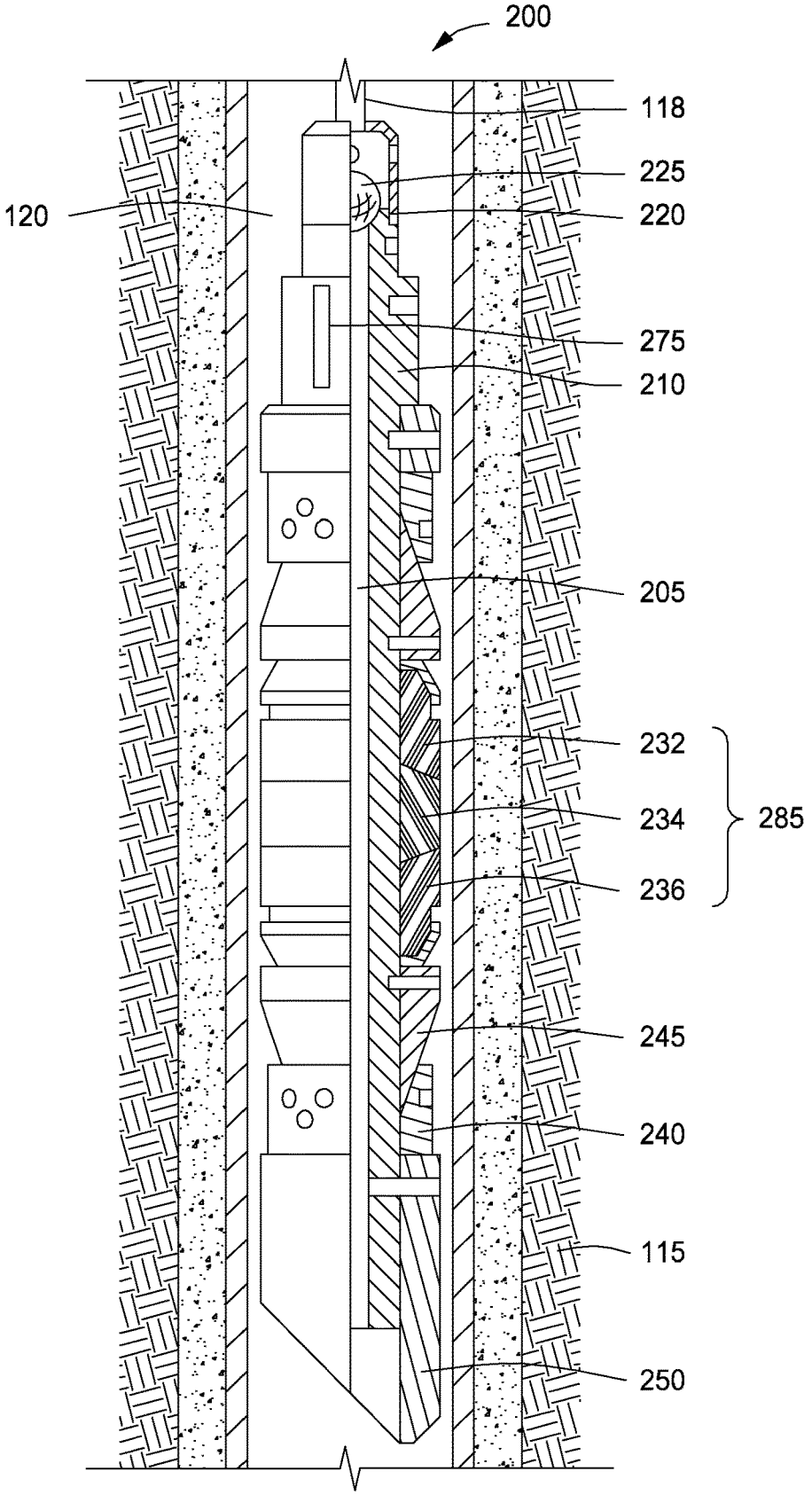
FIG. 2 depicts an enlarged cross-sectional view of a downhole tool, according to one or more embodiments described herein.

Referring now to FIG. 2, with continued reference to FIG. 1, one specific type of downhole tool described herein is a frac plug wellbore zonal isolation device for use during a well stimulation/fracturing operation. FIG. 2 illustrates a cross-sectional view of an exemplary frac plug 200 being lowered into a wellbore 120 on a tool string 118. As previously mentioned, the frac plug 200 generally comprises a body 210 and a sealing element 285. The sealing element 285, as depicted, comprises an upper sealing element 232, a center sealing element 234, and a lower sealing element 236. It will be appreciated that although the sealing element 285 is shown as having three portions (i.e., the upper sealing element 232, the center sealing element 234, and the lower sealing element 236), any other number of portions, or a single portion, may also be employed without departing from the scope of the present disclosure.

As depicted, the sealing element 285 is extending around the body 210; however, it may be of any other configuration suitable for allowing the sealing element 285 to form a fluid seal in the wellbore 120, without departing from the scope of the present disclosure. For example, in some embodiments, the body may comprise two sections joined together by the sealing element, such that the two sections of the body compress to permit the sealing element to make a fluid seal in the wellbore 120. Other such configurations are also suitable for use in the embodiments described herein. Moreover, although the sealing element 285 is depicted as located in a center section of the body 210, it will be appreciated that it may be located at any location along the length of the body 210, without departing from the scope of the present disclosure.

The body 210 of the frac plug 200 comprises an axial flowbore 205 extending therethrough. A cage 220 is formed at the upper end of the body 210 for retaining a ball 225 that acts as a one-way check valve. In particular, the ball 225 seals off the flowbore 205 to prevent flow downwardly therethrough, but permits flow upwardly through the flowbore 205. One or more slips 240 are mounted around the body 210 below the sealing element 285. The slips 240 are guided by a mechanical slip body 245. A tapered shoe 250 is provided at the lower end of the body 210 for guiding and protecting the frac plug 200 as it is lowered into the wellbore 120. An optional enclosure 275 for storing a chemical solution may also be mounted on the body 210 or may be formed integrally therein. In one embodiment, the enclosure 275 is formed of a frangible material.

The sealing element 285 is composed of a composite material of a rubber and a degradable acrylate-based polymer and the degradable acrylate-based polymer may be at least partially degradable in the presence of an aqueous fluid in a wellbore environment (e.g., water, an aqueous-based treatment fluid, and the like). That is, the degradable acrylate-based polymer forming a portion of the composite material forming the sealing element 285 may wholly degrade or partially degrade in the presence of an aqueous fluid; however, the amount of degradation is capable of causing the sealing element 285 to no longer maintain a fluid seal in the wellbore capable of maintaining differential pressure.

The degradable acrylate-based polymer forming at least a portion of the composite material forming the sealing element 285 may degrade by a number of mechanisms. For example, the sealing element 285 may degrade by swelling, dissolving, undergoing a chemical change, undergoing thermal degradation in combination with any of the foregoing, and any combination thereof. The aqueous fluid that degrades the degradable acrylate-based polymer or other degradable material described herein may be any aqueous fluid present in the wellbore environment including, but not limited to, fresh water, saltwater (e.g., water containing one or more salts dissolved therein), brine (e.g., saturated salt water), seawater, or combinations thereof. Accordingly, the aqueous fluid may comprise ionic salts. The aqueous fluid may come from the wellbore 120 itself (i.e., the subterranean formation) or may be introduced by a wellbore operator.

The sealing element 285 is composed of a composite material of a rubber and an acrylate-based polymer. As used herein, the term "rubber" excludes acrylate-based materials. In some embodiments, the composite material may be wholly or partially vulcanized, but need not be. As used herein, the term "vulcanized," and all grammatical variants thereof (e.g., "vulcanization," "vulcanize," and the like), refers to the chemical process of converting rubber polymers into more durable materials having superior mechanical properties by forming crosslinks between individual polymer chains, which does not necessitate the use of sulfur, although sulfur may be used. Suitable rubbers include, but are not limited to, a natural rubber, a synthetic rubber, and any combination thereof. Suitable synthetic rubbers may include, but are not limited to, styrene-butadiene, polyester urethane, bromo isobutylene isoprene, polybutadiene, chloro isobutylene isoprene, polychloroprene, chlorosulphonated polyethylene, epichlorohydrin, ethylene propylene, ethylene propylene diene monomer, polyether urethane, perfluorocarbon, fluorinated hydrocarbon, fluoro silicone, fluorocarbon, hydrogenated nitrile butadiene, polyisoprene, isobutylene, isoprene butyl, acrylonitrile butadiene, polyurethane, styrene ethylene-butylene styrene, polysiloxane, vinyl methyl silicone, acrylonitrile butadiene carboxy, styrene butadiene carboxy, polyether-ester, polyethylene terephthalate, polybutylene terephthalate, polyethylene oxide, ethylene oxide/propylene oxide copolymer, ethylene oxide/epichlorohydrin copolymer, ethylene oxide/allyl glycidyl ether copolymer, ethylene oxide/epichlorohydrin/allyl glycidyl ether terpolymer, ethylene oxide/propylene oxide/allyl glycidyl ether terpolymer, a maleic anhydride graft copolymer of ethylene/propylene, a maleic anhydride graft terpolymer of ethylene/propylene/monomer (e.g., trans-1,4-hexadiene, dicyclopentadiene, and 5-ethylidene-norbornene-2), any derivative thereof, and any combination thereof. Additional non-acrylate based polyester and polyethers may additionally be used as the rubber in forming the sealing element 285.

Suitable degradable acrylate-based polymers for use in the composite material forming the sealing element 285 may include, but are not limited to, a polyester acrylate (e.g., polyethyl acrylate, polybutylacrylate, polyester urethane acrylate, and the like); a methyl acrylate and ethylene copolymer; a butyl acrylate and ethylene copolymer; a polyester acrylate, ethylene, and maleic anhydride terpolymer; any derivative thereof; and any combination thereof.

Generally, the ratio of rubber to the degradable acrylate-based polymer in the composite material forming the sealing element 285 may be from an upper limit of about 95%, 90%, 85%, 80%, 75%, 70%, 65%, 60%, and 55% to a lower limit of about 15%, 20%, 25%, 30%, 35%, 40%, 45%, 50%, and 55% by weight of the composite material, encompassing any value and subset therebetween.

In some embodiments, the composite material forming the sealing element 285 may further comprise a filler material capable of increasing the structural rigidity and/or the degradation rate of the degradable acrylate-based polymer. For example, the filler material may chemically interact with the degradable acrylate-based polymers to accelerate their degradation or may themselves release an accelerant. Suitable filler materials may include, but are not limited to, aluminum, tin, zinc, carbon black, and any combination thereof. In some embodiments, the filler material may be present in the composite material forming the sealing element 285 in an amount in the range of from an upper limit of about 70%, 65%, 60%, 55%, 50%, 45%, and 40% to a lower limit of about 2%, 5%, 10%, 15%, 20%, 25%, 30%, 35%, and 40% by weight of the total composite material, encompassing any value and subset therebetween.

In some embodiments, the composite material forming the sealing element 285 may comprise another material capable of degrading in the presence of an aqueous fluid in a wellbore environment. Such additional material may be used to accelerate degradation of portions of the sealing element 285, the degradable acrylate-based polymer itself, and the like. Such additional materials may include, but are not limited to, polylactic acid; polyglycolic acid, any derivative thereof, and any combination thereof. In some embodiments, the additional degradable material may be present in the composite material forming the sealing element 285 in an amount in the range of from an upper limit of about 95%, 90%, 85%, 80%, 75%, 70%, 65%, 60%, 55%, and 50% to a lower limit of about 2%, 5%, 10%, 15%, 20%, 25%, 30%, 35%, 40%, 45%, and 50% by weight of the total composite material, encompassing any value and subset therebetween.

Each of the individual components forming the sealing element 285 (i.e., the composite material and any additional material embedded therein) is preferably present therein uniformly (i.e., distributed uniformly throughout). The choices and relative amounts of each component are adjusted for the particular downhole operation (e.g., fracturing, workover, and the like) and the desired degradation rate of the sealing element 285. Factors that may affect the selection and amount of components may include, for example, the expected amount of aqueous fluid in the wellbore environment, the amount of elasticity required for the sealing element 285 (e.g., based on wellbore diameter, for example), and the like.

The body 210, or a portion thereof, may be composed of any material sufficiently rigid to provide structural integrity to the downhole tool, or frac plug 200. Suitable materials for forming the body 210 may include, but are not limited to, a metal (e.g., aluminum, steel, stainless steel, nickel, copper, cast iron, galvanized and non-galvanized materials, and the like), a plastic (e.g., polystyrene, polypropylene, curable resins, and the like), and any combination thereof.

Figure 3:
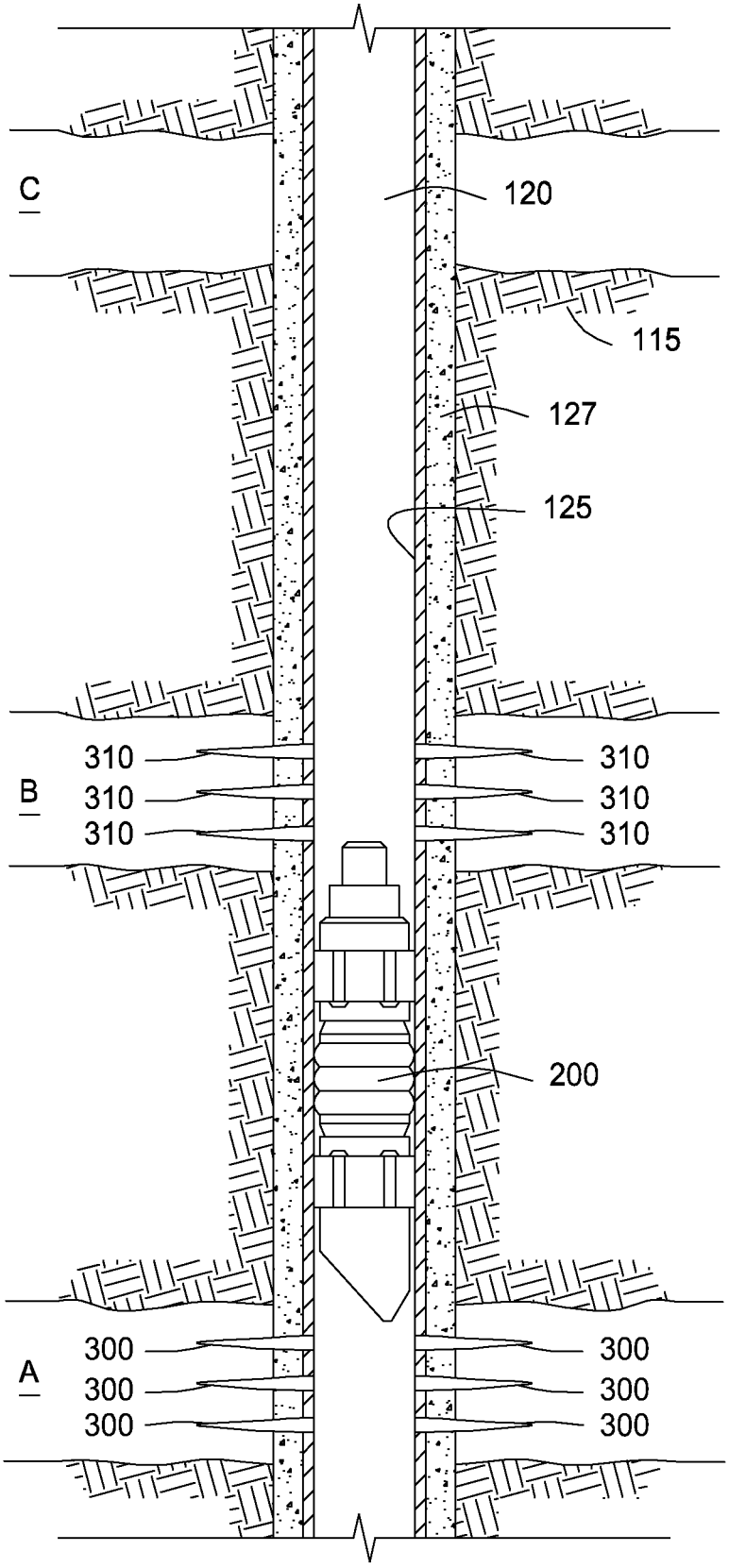
FIG. 3 shows an enlarged cross-sectional view of a downhole tool in operation, according to one or more embodiments described herein.

Referring again to FIG. 2, in operation the frac plug 200 may be used in a downhole fracturing operation to isolate a zone of the formation 115 below the frac plug 200. Referring now to FIG. 3, with continued reference to FIG. 2, the frac plug 200 is shown disposed between producing zone A and producing zone B in formation 115. In a conventional fracturing operation, before setting the frac plug 200 to isolate zone A from zone B, a plurality of perforations 300 are made by a perforating tool (not shown) through the casing 125 and cement 127 to extend into producing zone A. Then a well stimulation fluid is introduced into the wellbore 120, such as by lowering a tool (not shown) into the wellbore 120 for discharging the fluid at a relatively high pressure or by pumping the fluid directly from the derrick 112 (FIG. 1) into the wellbore 120. The well stimulation fluid passes through the perforations 300 into producing zone A of the formation 115 for stimulating the recovery of fluids in the form of oil and gas containing hydrocarbons. These production fluids pass from zone A, through the perforations 300, and up the wellbore 120 for recovery at the surface 105 (FIG. 1).

The frac plug 200 is then lowered by the tool string 118 (FIG. 1) to the desired depth within the wellbore 120, and the sealing element 285 (FIG. 2) is set against the casing 125, thereby isolating zone A as depicted in FIG. 3. Due to the design of the frac plug 200, the flowbore 205 (FIG. 2) of the frac plug 200 allows fluid from isolated zone A to flow upwardly through the frac plug 200 while preventing flow downwardly into the isolated zone A. Accordingly, the production fluids from zone A continue to pass through the perforations 300, into the wellbore 120, and upwardly through the flowbore 205 of the frac plug 200, before flowing into the wellbore 120 above the frac plug 200 for recovery at the surface 105.

After the frac plug 200 is set into position, as shown in FIG. 3, a second set of perforations 310 may then be formed through the casing 125 and cement 127 adjacent intermediate producing zone B of the formation 115. Zone B is then treated with well stimulation fluid, causing the recovered fluids from zone B to pass through the perforations 310 into the wellbore 120. In this area of the wellbore 120 above the frac plug 200, the recovered fluids from zone B will mix with the recovered fluids from zone A before flowing upwardly within the wellbore 120 for recovery at the surface 105.

If additional fracturing operations will be performed, such as recovering hydrocarbons from zone C, additional frac plugs 200 may be installed within the wellbore 120 to isolate each zone of the formation 115. Each frac plug 200 allows fluid to flow upwardly therethrough from the lowermost zone A to the uppermost zone C of the formation 115, but pressurized fluid cannot flow downwardly through the frac plug 200.

After the fluid recovery operations are complete, the frac plug 200 must be removed from the wellbore 120. In this context, as stated above, the degradable acrylate-based polymer and any other degradable material in the composite material forming the sealing element 285 (FIG. 2) of the frac plug 200 may degrade by exposure to an aqueous fluid in the wellbore environment, which may be from the formation itself, introduced fluids, or fluids used for the treatment operation, such as the stimulation operation. When the treatment fluid itself degrades the degradable acrylate-based polymer, it may contact the polymer and begin the degradation process during the stimulation operation (or other operation), but delay degradation sufficiently that the sealing element 285 maintains a seal for the duration of the operation. Combinations of degradability are also suitable, without departing from the scope of the present disclosure, as discussed above, for example.

Accordingly, in an embodiment, the frac plug 200 is designed to decompose over time while operating in a wellbore environment, thereby eliminating the need to mill or drill the frac plug 200 out of the wellbore 120. Thus, by exposing the frac plug 200 to an aqueous fluid in the wellbore environment, at least some of its components will decompose (e.g., the degradable acrylate-based polymer), causing the frac plug 200 to lose structural and/or functional integrity and release from the casing 125. The remaining components of the frac plug 200 will simply fall to the bottom of the wellbore 120. In various alternate embodiments, degrading one or more components of a downhole tool 100 performs an actuation function, opens a passage, releases a retained member, or otherwise changes the operating mode of the downhole tool 100. Also, as described above, the material or components embedded therein for forming the body 210 and sealing element 285 of the frac plug 200 may be selected to control the decomposition rate of the frac plug 200.

Referring again to FIG. 1, removing the downhole tool 100, described herein from the wellbore 120 is more cost effective and less time consuming than removing conventional downhole tools, which require making one or more trips into the wellbore 120 with a mill or drill to gradually grind or cut the tool away. Instead, the downhole tools 100 described herein are removable by simply exposing the tools 100 to an aqueous fluid in a wellbore environment, which may be natural or introduced, over time. The foregoing descriptions of specific embodiments of the downhole tool 100, and the systems and methods for removing the tool 100 from the wellbore 120 have been presented for purposes of illustration and description and are not intended to be exhaustive or to limit this disclosure to the precise forms disclosed. Many other modifications and variations are possible. In particular, the type of downhole tool 100, or the particular components that make up the downhole tool 100 (e.g., the body and sealing element) may be varied. For example, instead of a frac plug 200 (FIG. 2), the downhole tool 100 may comprise a bridge plug, which is designed to seal the wellbore 120 and isolate the zones above and below the bridge plug, allowing no fluid communication in either direction. Alternatively, the downhole tool 100 could comprise a packer that includes a shiftable valve such that the packer may perform like a bridge plug to isolate two formation zones, or the shiftable valve may be opened to enable fluid communication therethrough. Similarly, the downhole tool 100 could comprise a wiper plug or a cement plug.

While various embodiments have been shown and described herein, modifications may be made by one skilled in the art without departing from the scope of the present disclosure. The embodiments described here are exemplary only, and are not intended to be limiting. Many variations, combinations, and modifications of the embodiments disclosed herein are possible and are within the scope of the disclosure. Accordingly, the scope of protection is not limited by the description set out above, but is defined by the claims which follow, that scope including all equivalents of the subject matter of the claims.

Embodiments disclosed herein include Embodiment A, Embodiment B, and Embodiment C.

Embodiment A: A downhole tool comprising: a body; and a sealing element, wherein the sealing element is composed of a composite material comprising a rubber and a degradable acrylate-based polymer, and wherein at least a portion of the degradable acrylate-based polymer degrades when exposed to an aqueous fluid in a wellbore environment.

Embodiment A may have one or more of the following additional elements in any combination:

Element A1: Wherein the rubber is a natural rubber, a synthetic rubber, and any combination thereof.

Element A2: Wherein the degradable acrylate-based polymer is selected from the group consisting of a polyester acrylate; a methyl acrylate and ethylene copolymer; a butyl acrylate and ethylene copolymer; a polyester acrylate, ethylene, and maleic anhydride terpolymer; and any combination thereof.

Element A3: Wherein the sealing element further comprises a filler material, the filler material capable of at least one of increasing the structural rigidity and the degradation rate of the degradable acrylate-based polymer.

Element A4: Wherein the filler material is selected from the group aluminum, tin, zinc, sodium, carbon black, and any combination thereof.

Element A5: Wherein the sealing element further comprises polylactic acid, polyglycolic acid, any derivative thereof, and any combination thereof.

Element A6: Wherein the downhole tool is a wellbore zonal isolation device.

Element A7: Wherein the wellbore zonal isolation device is selected from the group consisting of a frac plug, a bridge plug, a packer, or a cement plug.

By way of non-limiting example, exemplary combinations applicable to Embodiment A include: A with A3 and A5; A with A1, A3, and A7; A with A with A6; A with A4 and A5; A with A5 and A7.

Embodiment B: A method comprising: providing a downhole tool comprising a body and a sealing element, the sealing element being composed of a composite material comprising a rubber and a degradable acrylate-based polymer, and wherein at least a portion of the degradable acrylate-based polymer degrades when exposed to an aqueous fluid in a wellbore environment; installing the downhole tool in a wellbore; isolating a portion of the wellbore with the sealing element, the sealing element capable of holding a differential pressure; performing a downhole operation; and degrading at least a portion of the degradable acrylate-based polymer due to exposure to an aqueous fluid in the wellbore environment.

Embodiment B may have one or more of the following additional elements in any combination:

Element B1: Wherein the rubber is a natural rubber, a synthetic rubber, and any combination thereof.

Element B2: Wherein the degradable acrylate-based polymer is selected from the group consisting of a polyester acrylate; a methyl acrylate and ethylene copolymer; a butyl acrylate and ethylene copolymer; a polyester acrylate, ethylene, and maleic anhydride terpolymer; and any combination thereof.

Element B3: Wherein the sealing element further comprises a filler material, the filler material capable of at least one of increasing the structural rigidity and the degradation rate of the degradable acrylate-based polymer.

Element B4: Wherein the filler material is selected from the group aluminum, tin, zinc, sodium, carbon black, and any combination thereof.

Element B5: Wherein the sealing element further comprises polylactic acid, polyglycolic acid, any derivative thereof, and any combination thereof.

Element B6: Wherein the downhole tool is a wellbore zonal isolation device.

Element B7: Wherein the wellbore zonal isolation device is selected from the group consisting of a frac plug, a bridge plug, a packer, or a cement plug.

By way of non-limiting example, exemplary combinations applicable to Embodiment B include: B with B2 and B3; B with B1, B4, and B7; B with B1 and B5; B with B6 and B7.

Embodiment C: A system comprising: a wellbore; and a downhole tool capable of being disposed in the wellbore to fluidly seal two sections thereof, the downhole tool comprising a body and a sealing element, the sealing element being composed of a composite material comprising a rubber and a degradable acrylate-based polymer, and wherein at least a portion of the degradable acrylate-based polymer degrades when exposed to an aqueous fluid in a wellbore environment.

Embodiment C may have one or more of the following additional elements in any combination:

Element C1: Wherein the rubber is a natural rubber, a synthetic rubber, and any combination thereof.

Element C2: Wherein the degradable acrylate-based polymer is selected from the group consisting of a polyester acrylate; a methyl acrylate and ethylene copolymer; a butyl acrylate and ethylene copolymer; a polyester acrylate, ethylene, and maleic anhydride terpolymer; and any combination thereof.

Element C3: Wherein the sealing element further comprises a filler material, the filler material capable of at least one of increasing the structural rigidity and the degradation rate of the degradable acrylate-based polymer.

Element C4: Wherein the filler material is selected from the group aluminum, tin, zinc, sodium, carbon black, and any combination thereof.

Element C5: Wherein the sealing element further comprises polylactic acid, polyglycolic acid, any derivative thereof, and any combination thereof.

Element C6: Wherein the downhole tool is a wellbore zonal isolation device.

Element C7: Wherein the wellbore zonal isolation device is selected from the group consisting of a frac plug, a bridge plug, a packer, or a cement plug.

By way of non-limiting example, exemplary combinations applicable to Embodiment C include: C with C1 and C2; C with C2, C3, C5, and C6; C with C4 and C7; C with C3 and C6.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A downhole tool comprising:

a body; and a sealing element, wherein the sealing element is compressible by two sections of the body to make a fluid seal in a wellbore, and wherein the sealing element consists of a filler, an additional material, and a composite material comprising a rubber and a degradable acrylate-based polymer, wherein the ratio of rubber to the degradable acrylate-based polymer is in a range of about 95% to about 15% by weight of the composite material, wherein at least a portion of the composite material degrades by swelling when exposed to an aqueous fluid in a wellbore environment, and wherein the filler material is selected from the group consisting of aluminum, tin, zinc, sodium, carbon black, and any combination thereof, wherein the additional material is selected from the group consisting of polyglycolic acid, and derivative of polyglycolic acid, and any combination thereof.

2. The downhole tool of claim 1, wherein the rubber is a synthetic rubber.

3. The downhole tool of claim 1, wherein the degradable acrylate-based polymer is selected from the group consisting of a polyester acrylate; a methyl acrylate and ethylene copolymer; a butyl acrylate and ethylene copolymer; a polyester acrylate, ethylene, and maleic anhydride terpolymer; and any combination thereof.

4. The downhole tool of claim 1, wherein the downhole tool is a wellbore zonal isolation device.

5. The downhole tool of claim 4, wherein the wellbore zonal isolation device is selected from the group consisting of a frac plug, a bridge plug, a packer, or a cement plug.

6. The downhole tool of claim 1, wherein the additional material is present in an amount in the range of about 95% to about 2% by weight of the total composite material.

7. The downhole tool of claim 1, wherein the downhole tool comprises a frac plug, a bridge plug or a cement plug.

8. The downhole tool of claim 1, wherein the downhole tool comprises a frac plug.

9. A method comprising:

providing a downhole tool comprising a body and a sealing element, the sealing element is compressible by two sections of the body to make a fluid seal in a wellbore the sealing element consisting of a filler, an additional material, and a composite material comprising a rubber and a degradable acrylate-based polymer, wherein the ratio of rubber to the degradable acrylate-based polymer is in a range of about 95% to about 15% by weight of the composite material, and wherein at least a portion of the composite material degrades by swelling when exposed to an aqueous fluid in a wellbore environment;

installing the downhole tool in a wellbore;

isolating a portion of the wellbore with the sealing element, the sealing element capable of holding a differential pressure;

performing a downhole operation; and dissolving at least a portion of the composite material due to exposure to an aqueous fluid in the wellbore environment, wherein the filler material is selected from the group consisting of aluminum, tin, zinc, sodium, carbon black, and any combination thereof;

wherein the additional material is selected from the group consisting of wherein the additional material is selected from the group consisting of polyglycolic acid, and derivative of polyglycolic acid, and any combination thereof.

10. The method of claim 9, wherein the rubber is a synthetic rubber.

11. The method of claim 9, wherein the degradable acrylate-based polymer is selected from the group consisting of a polyester acrylate; a methyl acrylate and ethylene copolymer; a butyl acrylate and ethylene copolymer; a polyester acrylate, ethylene, and maleic anhydride terpolymer; and any combination thereof.

12. The method of claim 9, wherein the addition material is present in an amount in the range of about 95% to about 2% by weight of the total composite material.

13. The method of claim 9, wherein the downhole tool comprises a frac plug, a bridge plug or a cement plug.

14. A system comprising:

a wellbore; and a downhole tool capable of being disposed in the wellbore to fluidly seal two sections thereof, the downhole tool comprising a body and a sealing element, the sealing element being compressible by two sections of the body to make a fluid seal in a wellbore, and the sealing element consisting of a filler, an additional material, and a composite material comprising a rubber and a degradable acrylate-based polymer, wherein the ratio of rubber to the acrylate-based polymer is in a range of about 95% to about 15% by weight of the composite material, and wherein at least a portion of the composite material degrades by swelling when exposed to an aqueous fluid in a wellbore environment, wherein the filler material is selected from the group consisting of aluminum, tin, zinc, sodium, carbon black, and any combination thereof, wherein the additional material is selected from the group consisting of polyglycolic acid, and derivative of polyglycolic acid, and any combination thereof.

15. The system of claim 14, wherein the rubber is a synthetic rubber.

16. The system of claim 14, wherein the degradable acrylate-based polymer is selected from the group consisting of a polyester acrylate; a methyl acrylate and ethylene copolymer; a butyl acrylate and ethylene copolymer; a polyester acrylate, ethylene, and maleic anhydride terpolymer; and any combination thereof.

17. The system of claim 14, wherein the additional material is present in an amount in the range of about 95% to about 2% by weight of the total composite material.

18. The system of claim 14, wherein the downhole tool comprises a frac plug, a bridge plug or a cement plug.

* * * * *